US008480817B2

(12) United States Patent
Jain et al.

(10) Patent No.: US 8,480,817 B2
(45) Date of Patent: Jul. 9, 2013

(54) THERMAL MECHANICAL PROCESSING OF STAINLESS STEEL

(75) Inventors: Sushil K. Jain, Indianapolis, IN (US); Stephen N. Hammond, Brownsburg, IN (US)

(73) Assignee: Rolls-Royce Corporation, Indianapolis, IN (US)

( * ) Notice: Subject to any disclaimer, the term of this patent is extended or adjusted under 35 U.S.C. 154(b) by 161 days.

(21) Appl. No.: 12/833,996

(22) Filed: Jul. 11, 2010

(65) Prior Publication Data

US 2011/0108164 A1 May 12, 2011

Related U.S. Application Data

(60) Provisional application No. 61/224,652, filed on Jul. 10, 2009.

(51) Int. Cl.

| | |
|---|---|
| ***C23C 8/00*** | (2006.01) |
| ***C21D 8/00*** | (2006.01) |
| ***C21D 6/00*** | (2006.01) |

(52) U.S. Cl.
USPC ..... 148/226; 420/38

(58) Field of Classification Search
USPC ..... 148/226
See application file for complete search history.

(56) References Cited

U.S. PATENT DOCUMENTS

| | | | | |
|---|---|---|---|---|
| 3,994,099 | A * | 11/1976 | Palmer | 451/217 |
| 4,154,629 | A * | 5/1979 | Asai et al. | 148/232 |
| 4,617,817 | A | 10/1986 | Gegel et al. | |
| 5,002,729 | A | 3/1991 | Wert et al. | |
| 5,328,530 | A | 7/1994 | Semiatin et al. | |
| 5,714,114 | A * | 2/1998 | Uehara | 420/61 |
| 6,233,500 | B1 | 5/2001 | Malas et al. | |
| 6,464,801 | B2 | 10/2002 | Kuehmann et al. | |
| 6,500,284 | B1 | 12/2002 | Zhou et al. | |
| 7,208,052 | B2 | 4/2007 | Hammond et al. | |
| 2005/0133119 | A1 | 6/2005 | Hammond et al. | |
| 2006/0213592 | A1 | 9/2006 | Ko et al. | |

OTHER PUBLICATIONS

ASM International, Materials Park, Ohio, Heat Treating: "Vacuum Carburizing", vol. 4, pp. 348-351.*

* cited by examiner

*Primary Examiner* — Jessee R. Roe
(74) *Attorney, Agent, or Firm* — Krieg DeVault LLP

(57) ABSTRACT

One embodiment of the present invention is a unique method for thermal mechanical processing of a martensitic stainless steel. Other embodiments include apparatuses, systems, devices, hardware, methods, and combinations for thermal mechanical processing of a martensitic stainless steel and forged objects resulting therefrom. Further embodiments, forms, features, aspects, benefits, and advantages of the present application shall become apparent from the description and figures provided herewith.

28 Claims, 15 Drawing Sheets

THERMAL MECHANICAL PROCESSING OF STAINLESS STEEL

CROSS REFERENCE TO RELATED APPLICATIONS

The present application claims the benefit of U.S. Provisional Patent Application 61/224,652, filed Jul. 10, 2009, and is incorporated herein by reference.

FIELD OF THE INVENTION

The present invention relates generally to a method for thermal mechanical processing of stainless steel, and more particularly, of martensitic stainless steel.

BACKGROUND

Forging, carburization and heat treating of materials remain an area of interest. Some existing systems have various shortcomings, drawbacks, and disadvantages relative to certain applications. Accordingly, there remains a need for further contributions in this area of technology.

SUMMARY

One embodiment of the present invention is a unique method for thermal mechanical processing of a martensitic stainless steel. Other embodiments include apparatuses, systems, devices, hardware, methods, and combinations for thermal mechanical processing of a martensitic stainless steel and forged objects resulting therefrom. Further embodiments, forms, features, aspects, benefits, and advantages of the present application shall become apparent from the description and figures provided herewith.

BRIEF DESCRIPTION OF THE DRAWINGS

The description herein makes reference to the accompanying drawings wherein like reference numerals refer to like parts throughout the several views, and wherein.

DETAILED DESCRIPTION

Figure 1:
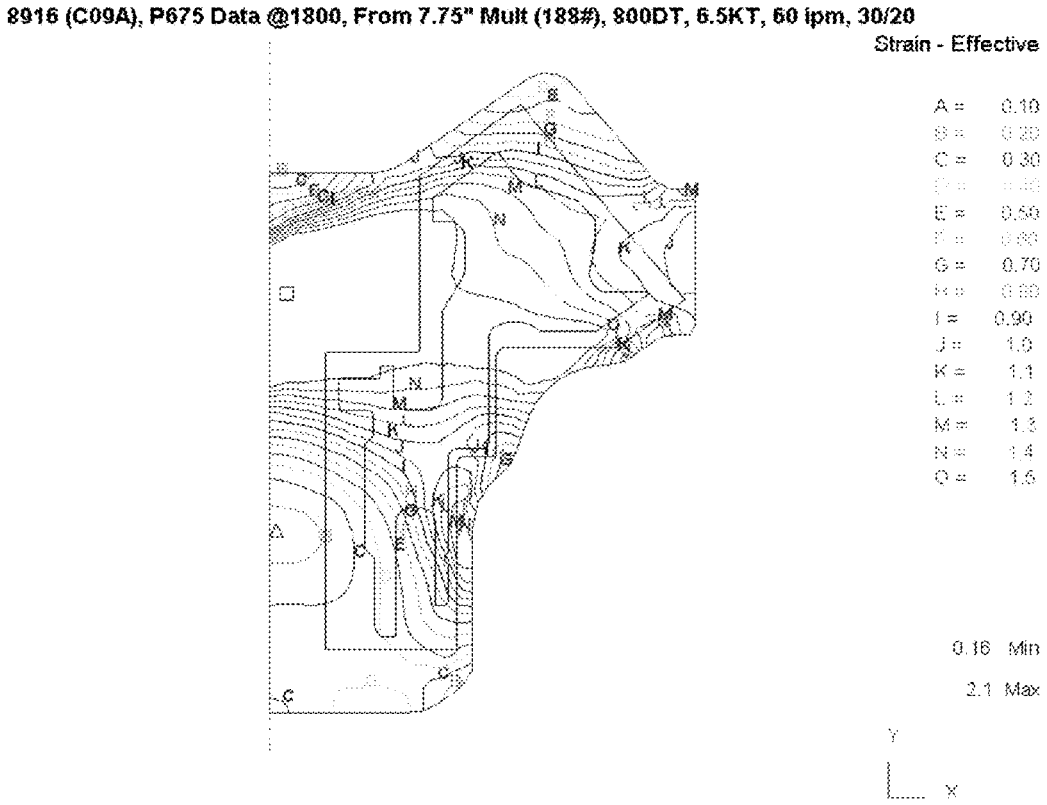
FIGS. 1 and 2 depict computer generated forging simulations for studying strain and temperature contours in portions of a forged object.

For purposes of promoting an understanding of the principles of the invention, reference will now be made to the embodiments illustrated in the drawings, and specific language will be used to describe the same. It will nonetheless be understood that no limitation of the scope of the invention is intended by the illustration and description of certain embodiments of the invention. In addition, any alterations and/or modifications of the illustrated and/or described embodiment(s) are contemplated as being within the scope of the present invention. Further, any other applications of the principles of the invention, as illustrated and/or described herein, as would normally occur to one skilled in the art to which the invention pertains, are contemplated as being within the scope of the present invention.

In the design and manufacture of steel components, there is often a need to obtain certain material properties, e.g., in selected portions of the component. For example, it is often desirable to manufacture gears, including but not limited to pinion and bull gears, with a hardened case on the gear teeth that resists wear and increases the strength of the teeth. Carburizing is a process used for hardening the surface and sub-surface of the steel component to form a hardened case. Carburizing may include an atmospheric carburization process or a vacuum carburization process. A vacuum carburization process employs a vacuum to reduce or prevent oxidation of the steel during the hardening process. In the vacuum carburization process, the component is heated to an elevated temperature within a carburizing furnace, and a carburizing gas is introduced into the environment so that carbon atoms are diffused into the surface and near sub-surface portions of the steel material. The carbon content in the surface and near sub-surface of the component is increased, forming a hardened case, while the carbon content within the core of the component remains unaltered. The characteristics of the component have thus been modified to provide a hardened outer surface, i.e., the case, surrounding an interior core having a different hardness than the case, e.g., a lower hardness.

One type of stainless steel of interest is martensitic stainless steel. One particular form of martensitic stainless steel of particular interest is available under the trade name, Pyrowear 675. Pyrowear 675 is available from Carpenter Technology Corporation and is described in U.S. Pat. No. 5,002,729, which is incorporated herein by reference. Pyrowear 675 is a stainless steel having a nominal chemical composition as set forth in Table 1. Although the present application is described with respect to Pyrowear 675, it will be understood that the present invention is also applicable to other martensitic stainless steels.

TABLE 1

| Composition | |
|---|---|
| Chromium | 13.1% |
| Nickel | 2.5% |
| Molybdenum | 1.8% |
| Cobalt | 5.3% |
| Manganese | 0.7% |
| Vanadium | 0.6% |
| Carbon | 0.07% |
| Si | 0.4% |
| N | 0.002% max. |
| Iron | balance |

Carburization increases the hardness and strength at the surface of Pyrowear 675 (the case). The case depth and the hardness of the case are a function of the time and temperature at which the object is carburized. Chromium carbides precipitate into the microstructure of the case during the carburization process.

In order to provide corrosion, fatigue, crack initiation and growth resistance, the case microstructure should be substantially free of carbide networking or carbide stringers along the grain boundaries. In one aspect continuous grain boundary carbide networks occur when carbides precipitate along the prior austenite grain boundaries in a form that completely engulfs the grain boundary without interruption. Fine carbides that are uniformly dispersed in the grains, and which do not form continuous carbide networks along the grain boundaries provide better corrosion, fatigue, crack initiation and growth resistance than where carbide networking or carbide stringers along the grain boundaries are present. The corrosion resistance of a case with continuous carbide networks along the grain boundaries may be compromised by the formation of a chromium depleted zone adjacent to the grain boundaries. Additionally, the fatigue and crack resistance of the forging may be decreased because the continuous carbide networks along the grain boundaries are typically brittle.

The grain size of Pyrowear 675 before carburizing correlates with the resulting case microstructure. For example, a starting grain size of billet or forged material having a grain size of ASTM E112 4 or larger typically results in an undesirable case microstructure due to the formation of the continuous carbide networks along the grain boundaries of the case. Previous attempts to manufacture large Pyrowear 675 forgings resulted in material with a coarse grain size of 3. These forgings when carburized resulted in case microstructures having continuous carbide networks along the grain boundaries.

The inventors discovered that an ASTM E112 starting grain size of 5 and finer will result in a carburized case having a desirable carbide distribution. The inventors have also discovered that a starting grain size of 7 and finer results in a carburized case of fine carbides and no continuous carbide networks along the grain boundaries.

Thermal-mechanical processing of Pyrowear 675 in accordance with the present invention achieves a fine grain size in forgings. In one embodiment, the fine grain size is achieved in one or more selected portions of the forgings, e.g., the gear teeth areas of a large gear forging. It will be understood that other portions of a forging may be selected to have a fine grain size. In one form, an ASTM E112 grain size of 7 and finer is achieved by forging Pyrowear 675 at 1800° F. or lower with a total effective strain of 0.5 or greater. In another form, the forging is performed at about 1800° F. In one further process operation, after the forging and carburizing, the hardening temperature of the Pyrowear 675 material is kept below 1900° F. to maintain a fine grain size, e.g., to maintain the as-forged grain size. In yet another form, a forging temperature of less than 1800° F. is employed to obtain a grain size of about 5 or finer in some embodiments, and a grain size of about 7 or finer in other embodiments.

Set forth herein are methods of forging Pyrowear 675 at a forging temperature of 1800° F. or lower and achieving a grain size of 5 or finer. For example, in one form, a total effective strain of 0.5 or greater is employed to achieve a grain size of 7 or finer. In another form, the total effective strain is at least about 0.5. The forging parameters disclosed herein were confirmed by a series of isothermal compression tests in which the temperature, strain rate and effective strain were varied, and in which the test specimens were evaluated for grain size.

The inventors determined that conventional billet conversion and forging temperatures are too high while the total strain imparted to the material during the forging process was too low for Pyrowear 675 to yield a desired fine grain structure free of delta ferrite stingers. The discovery was analyzed using Pyrowear 675 billets of 11", 7¾", 7", and 6" diameters purchased from Carpenter Technology Corporation (Specialty Steel). The billets were sectioned, and the microstructures were evaluated. The nominal grain size observed was ASTM 5. Large, blocky delta ferrite colonies and strings of delta ferrite colonies were very predominant in the 11" billet but mostly absent in smaller sizes. A thermal exposure study was conducted to evaluate the effect of temperature and exposure time on the grain size. Samples machined from the billets were exposed at 1700° F., 1800° F., 1900° F., 1950° F., 2000° F., and 2050° F. for 10 minutes, 1 hour, 2 hours, 3 hours, and 4 hours to simulate the soaking temperature and time prior to forging. Exposure at 1700° F. exhibited no grain coarsening but exposure at 1900° F. and above indicated a significant grain coarsening even after 10 minutes exposure. At 2050° F. exposure, grain coarsening to a grain size as large as ASTM 0 was indicated.

Hot compression testing to simulate the forging conditions using a matrix of varying temperatures, strain rates and total strains was used to confirm grain size reduction and low temperature forgeability by forging ½" dia. by ¾" tall specimens to ¼" (~70% reduction, 1.2 true strain) at 1700° F., 1800° F., 1850° F., 1900° F., 1950° F., 2000° F. and 2050° F. using strain rate of 0.03, 0.3 and 10.0 inch/inch/second. No edge cracking or other forging defects were observed. This hot compression testing confirmed that Pyrowear 675 can be forged as low as 1700° F., yielding grain sizes as small as ASTM 9.5 to 10.

Since the total strain applied during the hot compression testing was 1.2, the effect of smaller total strain variation on microstructure was not delineated. To confirm the effect of total strain variation on microstructure, a second test matrix was conducted on larger specimens of 1" diameter by 1½" tall specimens. The specimens were forged at 1800° F., 1850° F., 1900° F., and 1950° F. to 0.3, 0.5, and 0.7 total strain using 0.3 inch/inch/second strain rate. The grain size results confirmed that forging at the lower temperature of 1800° F. offered the finest grain sizes. In one form the total strain is applicable at all locations in the forging.

In one form mini-forgings (compression tests) were performed on ½ inch and one inch diameter straight cylindrical specimens represented strain only in axial direction and offered forgeability and flow stress characteristics of the material for use in finite element thermomechanical model for forging of gears. Thus to induce tri-axial strain in the material in a controlled manner and then evaluate the effect of aggregate strain on the structure, standard double cone geometry 7¼" dia. by 7¼" tall mults were selected for forging. A computer deformation model was used to plot the iso-strain contour lines when the 7¼" tall double cone mult was forged to 0.4, 0.5, 0.6, 0.8 and 1.2 strain reduction. After review of the model an additional model was run for 0.5 strain level (40% reduction in height). Contours of the strain profile were reviewed. A tri-axial strain ranging from 0.2 to 0.8 true strain in significant sections of the forged material was generated with the computer model. The computer model results were verified using double cone forgings that were forged at 1800° F. and 1900° F. in a forge shop environment. The 7.25" double cone forging mults were forged to a 4.4" height, representing 40% reduction. The mults were heated at the selected temperature and held at temperature for 3 hours, representing the production environment. Along with two double cone forging mults, two additional mults were also heated, one at each of 1800° F. and 1900° F. for 3 hours, but not forged, so as to evaluate the grain sizes prior to forging. Subsequently, all 4 pieces were sectioned, polished and etched. The grain sizes were measured and then correlated with strain profiles observed in the model. The grain size data were tabulated for 0.2, 03, 0.4, 0.5, 0.6, and 0.7 true strain (C-H) as shown below in Table 2.

TABLE 2

Grain Size, ASTM, Correlation with Tri-axial Strain from the Model

| Forging Temp. ° F. | No Strain | C = 0.2 | D = 0.3 | E = 0.4 | F = 0.5 | G = 0.6 | H = 0.7 |
|---|---|---|---|---|---|---|---|
| 1800 | 5.0 | 6.0 | 7.0 | 7.0 | 7.5 | 7.5 | 8.0 |
| 1900 | 2.5 | 4.5 | 5.0 | 6.5 | 7.0 | 7.0 | 7.0 |

The results confirm no significant increase in grain size in the specimen heated to 1800° F., but not forged, which slightly increased from ASTM 5.5 to 5.0. The grain size at the start of forging for 1900° F. double cone increased from the billet grain size of ASTM 5.5 to 2.5. The grain sizes for the double cone specimen forged at 1800° F. ranged from ASTM 6.0 to 8.0. Grain sizes for the double cone specimen forged at 1900° F. ranged from ASTM 4.5 to 7.0.

The data obtained from testing and modeling confirmed that forging temperatures of 1700° F.-1800° F. tend not to coarsen the grains during pre-soaking prior to forging, offer good forgeability, and yield grain recrystallization without grain growth during the forging sequence.

Subsequent to this testing, the forging process was scaled up to manufacturing 11" diameter by 1.75 inch thick multiple pancakes from 6" diameter billet. In order to determine a pre-forge thermal soaking sequence for optimum grain size, the sections of the billets were exposed to several potential pre-forging thermal soaking sequences consisting of a range of temperatures between 1700° F. and 1850° F. and times between 1 hour and 3 hours.

The average grain size in the as-received condition was ASTM 7 to 8 at the locations where the thermal exposure specimens were removed. Exposure at 1700° F. and 1800° F. had little effect on the grain size. Exposure at 1850° F. did affect the grain size with exposure for 3 hours raising the grain size to ASTM 6.0.

Twenty-two 6" tall mults were machined from 6" billet and forged to 1.75" at 1800° F. in two batches. For the first batch, 11 mults were loaded at 1500° F., held for 2.0 hours, ramped to 1700° F. in 0.5 hr, held at 1700° F. for 1.5 hr, ramped to 1800° F. in 0.5 hr, held at 1800° F. for 2.1 hr then forged and annealed at 1200 F for 8 hr. One of the mults was saved from being forged to examine the pre-forge grains size. For the second batch, 11 mults, were loaded in furnace at 1500° F., held for 2.0 hours, ramped to 1700° F. in 0.5 hours, held 1700° F. for 0.75 hours, ramp to 1800° F. in 0.5 hours, 1800° F. for 1.17 hours then forged, and then annealed at 1200° F. for 8 Hours. Again one of the mults was saved from being forged to examine the pre-forge grains size.

Time at 1800° F. had a slight effect on the grain size of the mult before forging. The mult from the first forge run held for 2.1 hours had a grain size of ASTM 5.0 to 6.0, while the mult held for 1.17 hours had a grain size of ASTM 6.0 to 7.0. Starting grain size had little effect on the final grain size for the forging. The final grain size depended mostly on the total strain. Strains of 0.8 or greater resulted in grain sizes of ASTM 10.0 or finer. A strain of 0.7 was required for significant refinement of the starting mult grain size. Strains less than 0.7 refined the starting grain size by one ASTM grain size. Little delta ferrite was observed in the micro specimens and delta ferrite content of the material was well under 1 percent.

Figure 2:
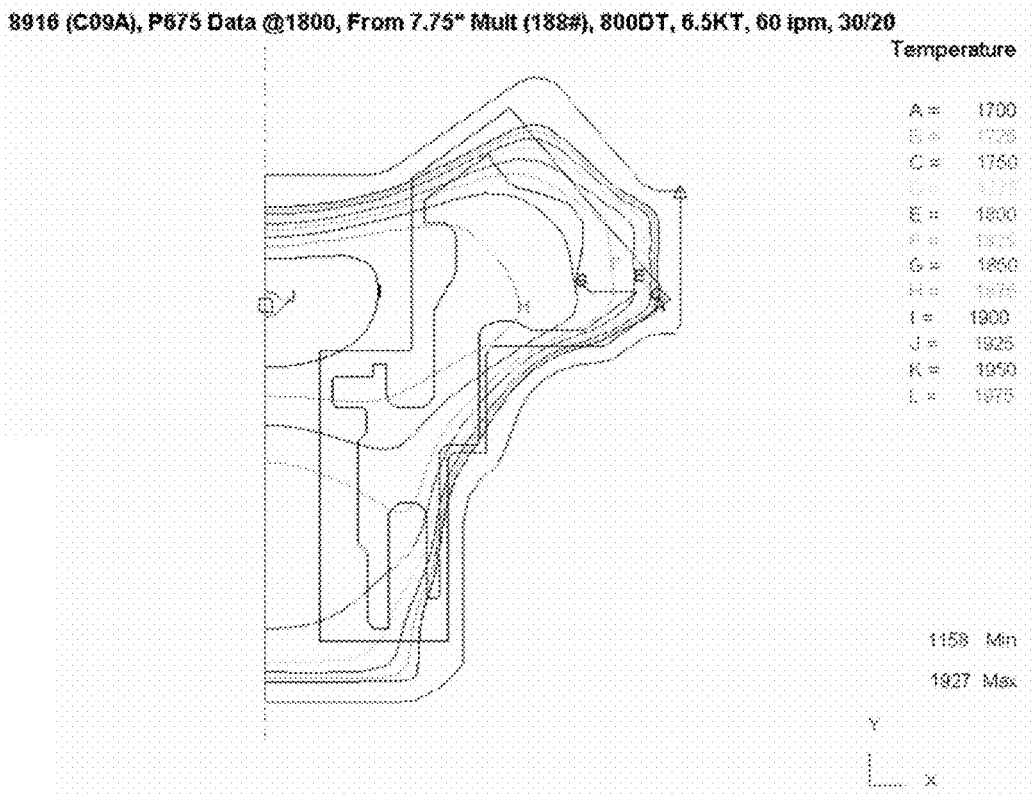

Forging simulations were generated on a computer using several forging configurations to produce a large gear forging with a diameter of 13" and height of 10" to determine the strain contours in critical areas. One commercially available program for forging simulations is DEFORM™ (Scientific Forming Technologies Corporation), which was used to create the present simulations. A final forging shape and procedure was designed to achieve a fine grain size, e.g., in a selected portion of the forging. The strain contours and temperature profiles of the finally selected forging shape are shown in FIGS. 1 and 2.

Figure 3:
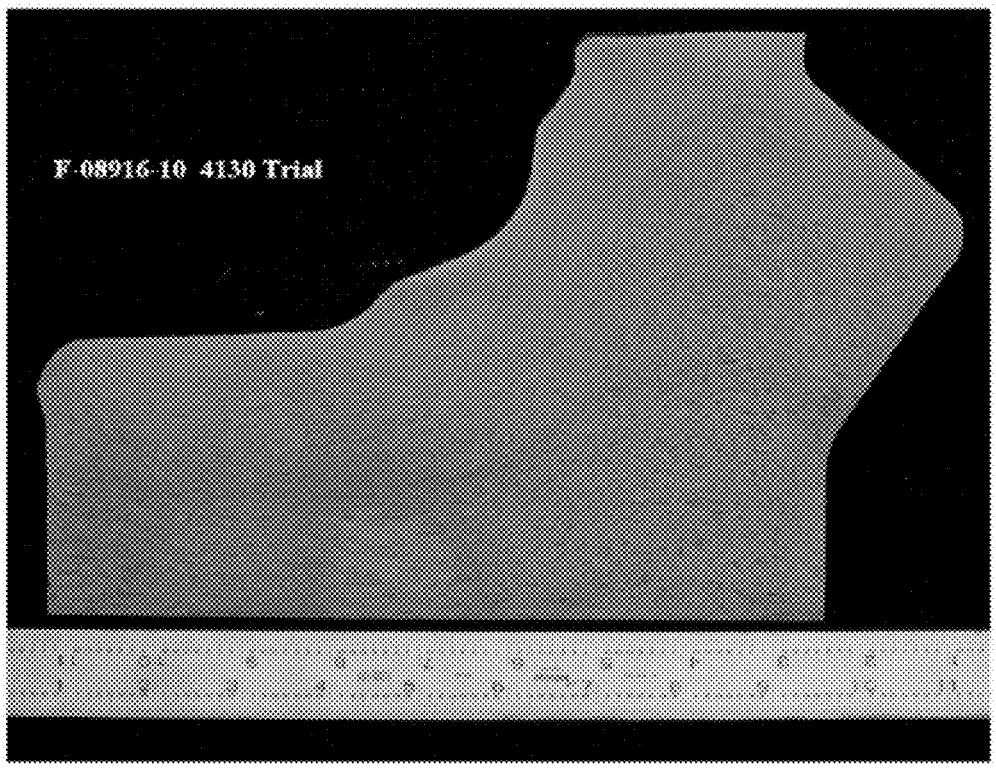
FIG. 3 is a micrograph of a 4130 steel forging that was used to confirm expected grain flow obtained via the forging simulations.
Figure 4:
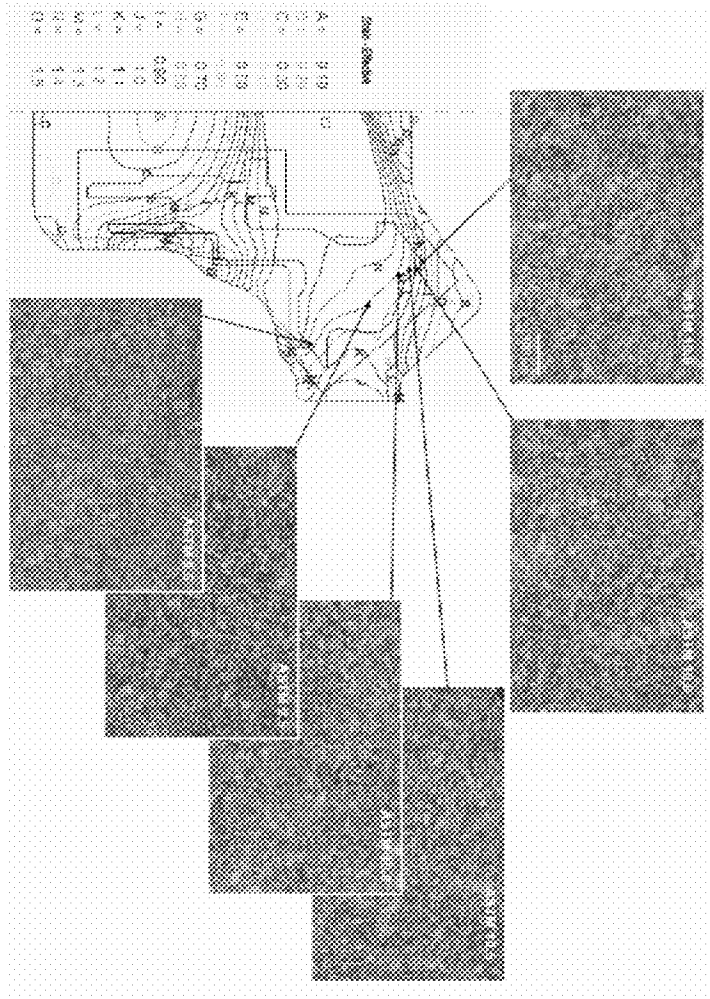
FIGS. 4-10 illustrate computer generated forging strain contour simulations along with micrographs of actual forgings illustrating grain sizes at various locations throughout a forging.
Figure 5:
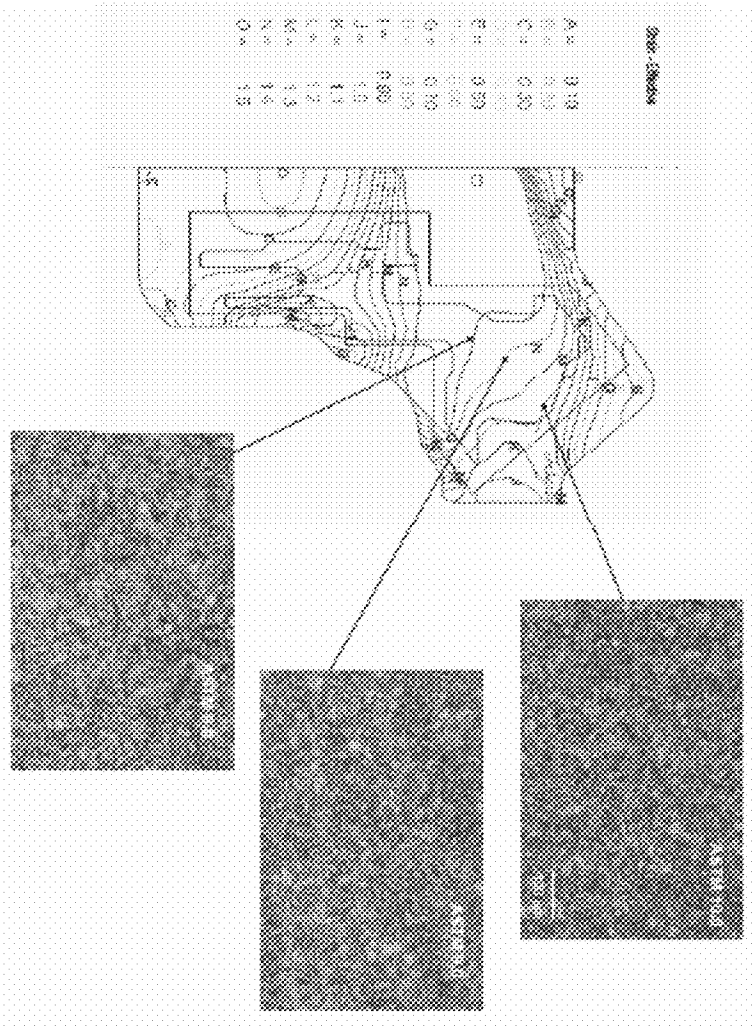
Figure 6:
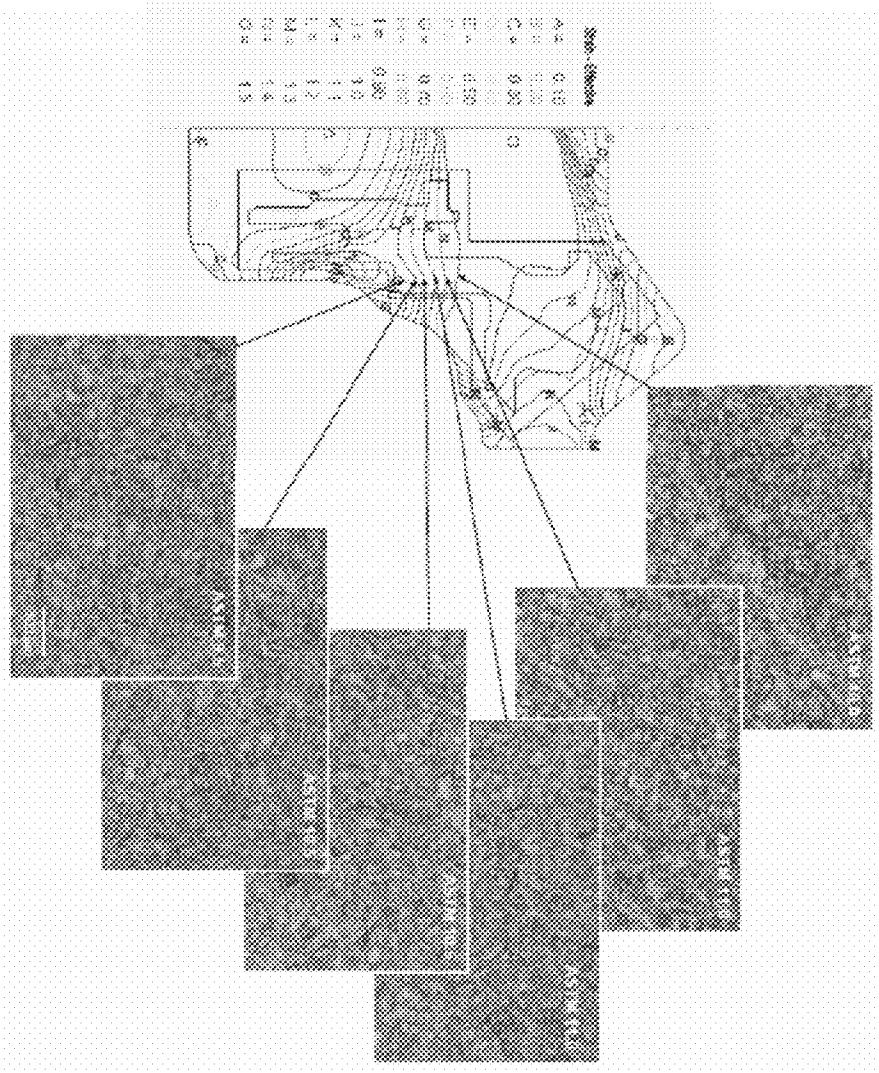
Figure 7:
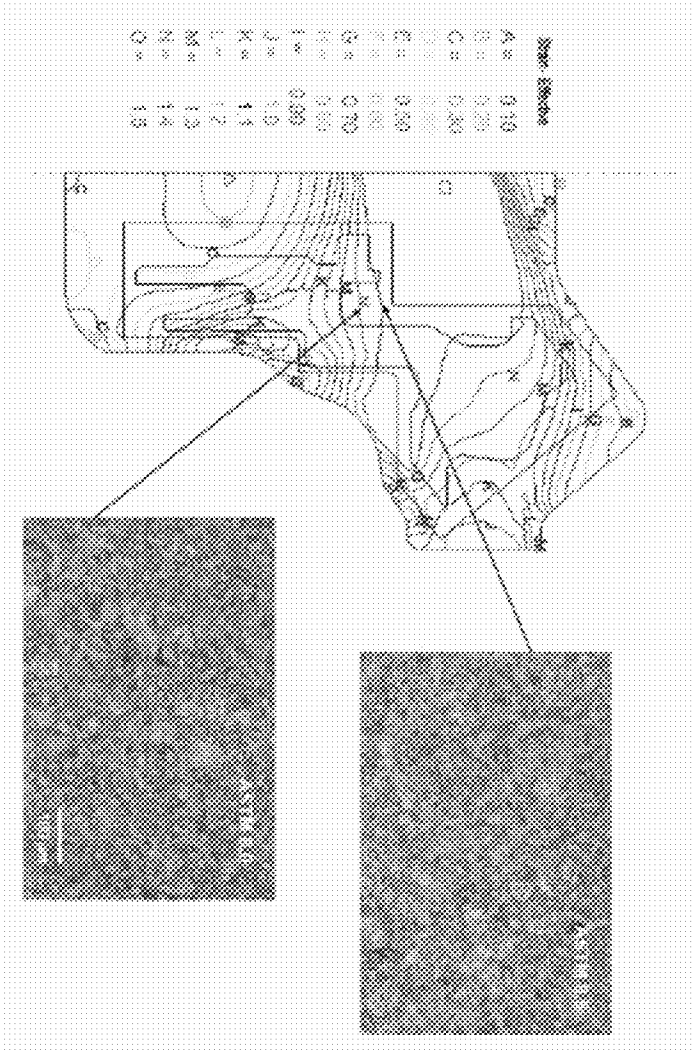
Figure 8:
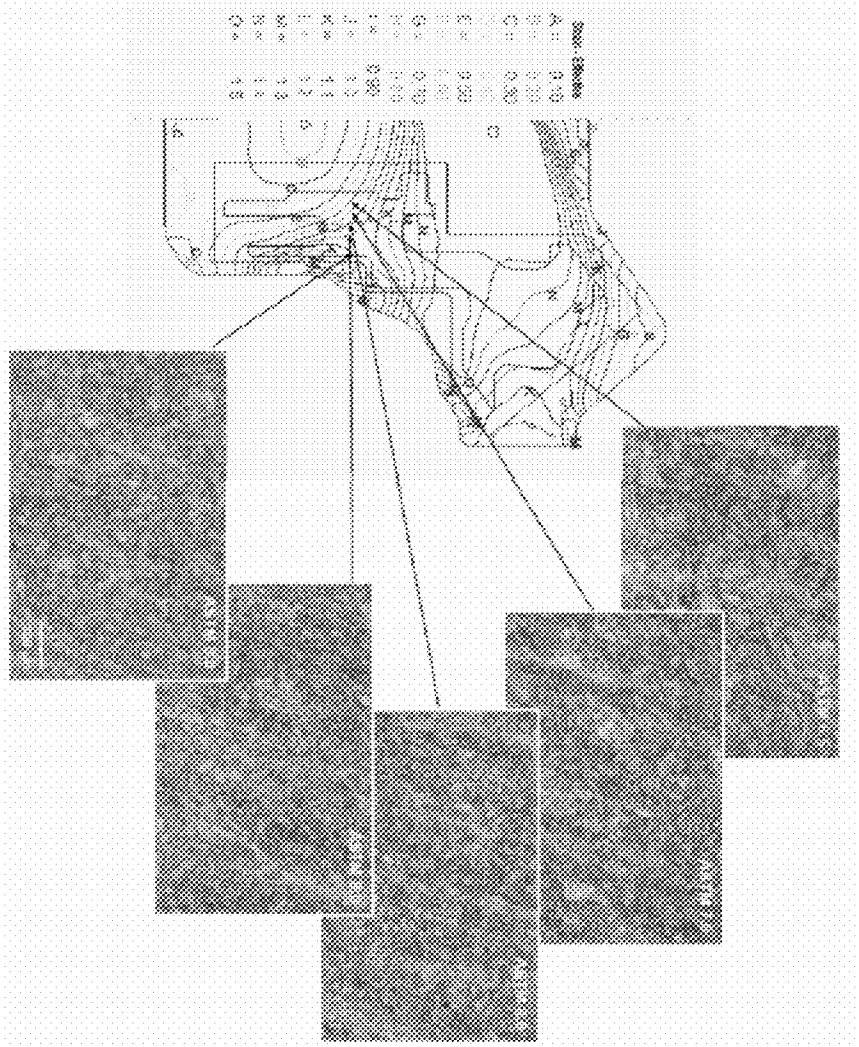
Figure 9:
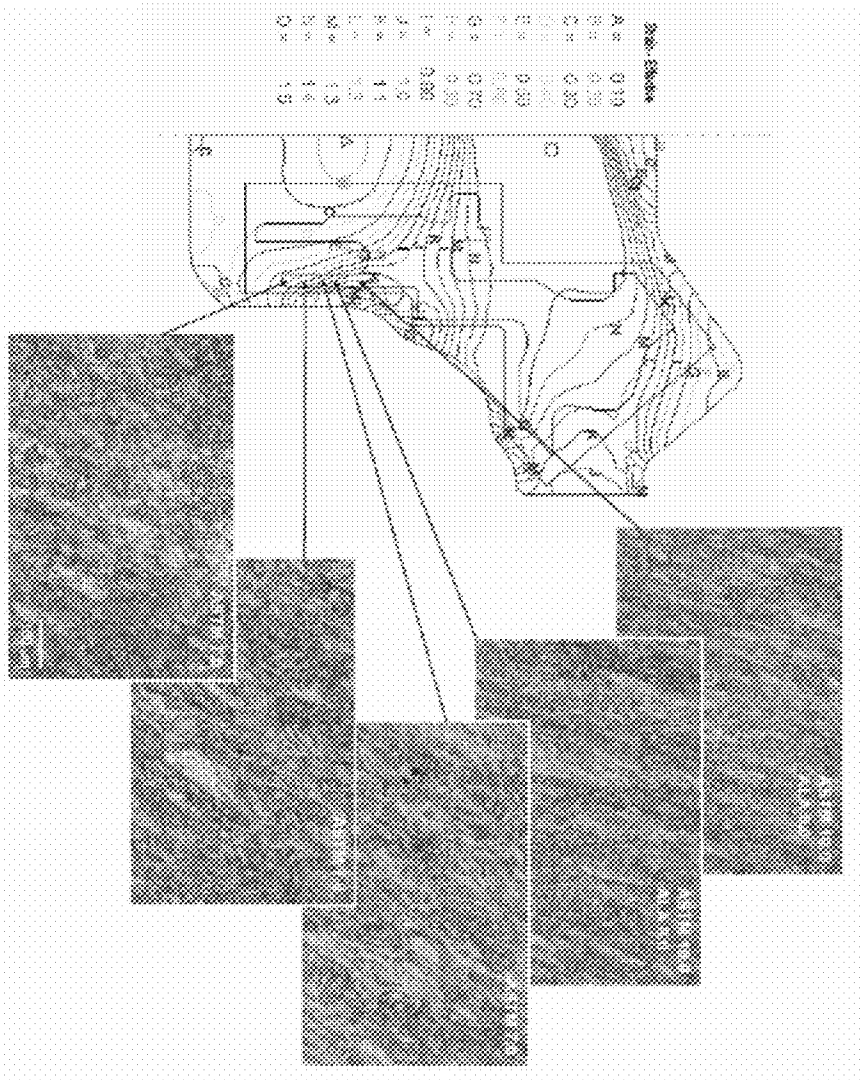
Figure 10:
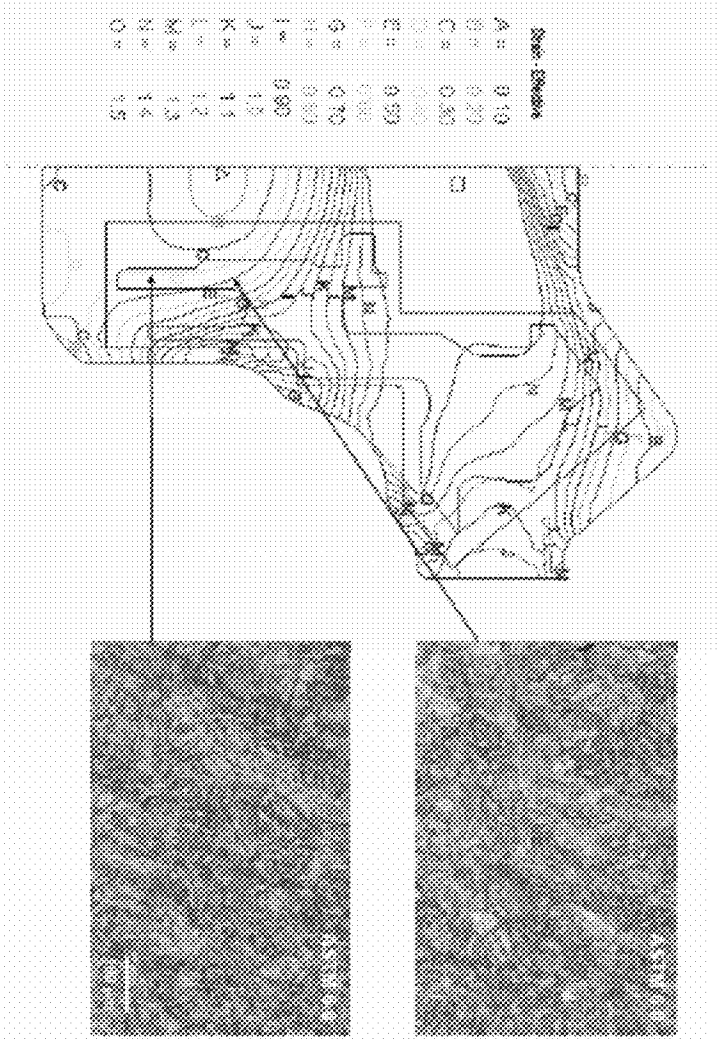
Figure 11:
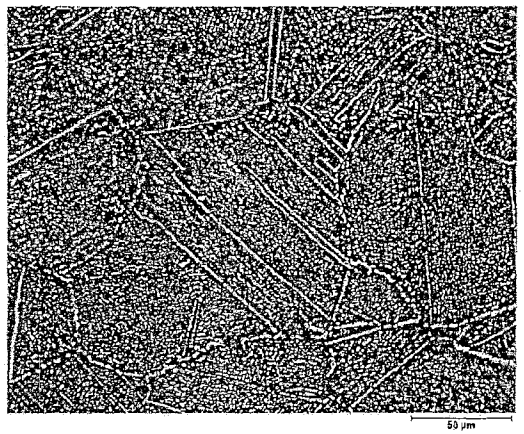
FIG. 11 is a micrograph illustrating a Pyrowear 675 case microstructure having continuous grain boundary carbide networking.

Forge tooling dies were manufactured to produce the selected forging shape. Tooling tryout was performed using three 7¾" diameter forging mults in 4130 alloy steel to prove out the die design. The grain flow of the 4130 steel forging, depicted in FIG. 3, matched the expected grain flow from the model.

Three Pyrowear 675 mults were cut from 7¾" round billet and heated to 1800° F. in three steps and forged in one push. Three forging steps included holds at 1500° F., 1700° F. and 1800° F., and then forging was performed at temperature of 1800° F. The forging mults were forged to the final shape in one push. The forgings were annealed at 1200° F. for 12 hours after forging. The Pyrowear 675 grain flow matched the expected grain flow predicted by the model. The grain flows from the Pyrowear 675 forgings showed good agreement with the model. Because of the low forging temperature, there was very little delta ferrite present in the forging.

FIGS. 4-10 are microphotographs showing microstructure and grain size from various locations throughout the forgings.

In one form, the present invention results achieved a fine grain size of ASTM E112 grain size of 10 in the gear teeth region of 13" diameter 10" high forgings and grain size of 9 to 8 in other critical areas.

The case and core microstructure of large Pyrowear 675 forgings after carburization, hardening, stabilization, and temper thermal cycle were verified as follows. A Pyrowear 675 billet was forged as set forth herein to obtain large gear forgings with a diameter of 13" and a height of 10" that had a fine grain size of ASTM E112 grain size 10 in the gear teeth region. Similarly pancake forgings were made with the forging process set forth herein, and the resulting grain size was 8. The forgings were vacuum carburized and heat treated to simulate thermal processing to meet requirements of large gears (in actual production manufacturing, the forgings may be subjected to material removal processing after forging, e.g., machining, hobbing, broaching, grinding, electrical discharge machining and/or chemical milling, to form the gear teeth prior to carburization). In one form, the criteria for carburized forgings included a hardness of greater than HRC 60 at the surface and of HRC 50 at case depth to a range of 0.060" to 0.076", depending upon gear service requirements, case compressive residual stress of −40KSI, and a grain size close to ASTM 5 in the core material. The present invention contemplates other case depths, including greater and lesser case depths.

In one form, the vacuum carburization/heat treat cycle comprises:

1. After loading in furnace and achieving sufficient vacuum level to prevent oxidation, heat the forged objects to 1800° F. and perform a hydrogen clean, nickel plating and/or preoxidation.
2. Reduce the temperature to 1650° F. and carburize using 55 seconds of metallurgical grade propane gas purge followed by 55 seconds of dwell time for one pulse cycle. In one form repeat this pulse cycle 520 times. The 520 pulse cycles is generally called the boost portion of the carburizing cycle where the propane gas is allowed to diffuse into the metal surface. In other embodiments, different cycle parameters may be employed. In one form, the gas impulses were followed by 80 hours of time for carbon diffusion into the steel, followed by an oil quench.

3. Anneal at 1200° F. for 6 hours.
4. Harden the forged objects by ramping temperature to 1700° F., hold for 20 minutes, ramp to 1900° F. hold 40 minutes, followed by an oil quench.
5. Stabilize at −200° F. for 2 hours
6. Temper at 600° F. for 2 hours, air cool, then re-temper at 600° F. for 2 hours, air cool It will be understood that other carburization/heat treat cycles may be employed in other embodiments, and the present inventions are not limited to the particular carburization/heat treat cycle sequence and parameters set forth above unless specifically provided to the contrary.

Figure 12:
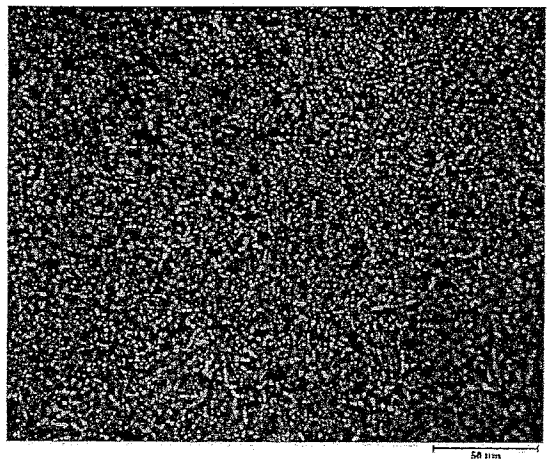
FIG. 12 is a micrograph illustrating a Pyrowear 675 large gear forging case microstructure obtained via an embodiment of the present invention, which illustrates dispersed carbides without carbide networking.
Figure 13:
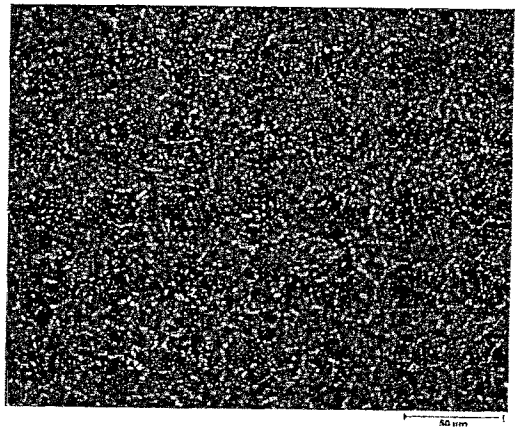
FIG. 13 is a micrograph illustrating a Pyrowear 675 pancake forging case microstructure obtained via an embodiment of the present invention, which illustrates dispersed carbides and the absence of carbide networking.

Previously, when specimens obtained from large gear Pyrowear 675 forgings with an ASTM E112 grain size of 3 were carburized and heat treated with the above cycle, the case microstructure was unacceptable. These forgings when carburized resulted in unacceptable case microstructures with continuous carbide networks along the grain. However, using the same carburization/HT cycle, the samples of Pyrowear 675 material obtained from a large forging made in accordance with the forging process set forth herein yielded a grain size of 10 per ASTM E112 after carburization and heat treatment. The resulting case microstructure exhibited uniformly dispersed carbides with no carbine stringers or carbide networking along the grain boundaries, for example, as illustrated in FIG. 12. Similarly, samples of pancake forgings made in accordance with the forging process set forth herein yielded a forged object with a grain size of 8, and was subject to carburization and heat treatment as set forth above. The resulting case microstructure of the pancake forging had uniformly dispersed carbides without any carbide stringers or carbide networking along the grain boundaries, e.g. as shown in FIG. 13.

Figure 14:
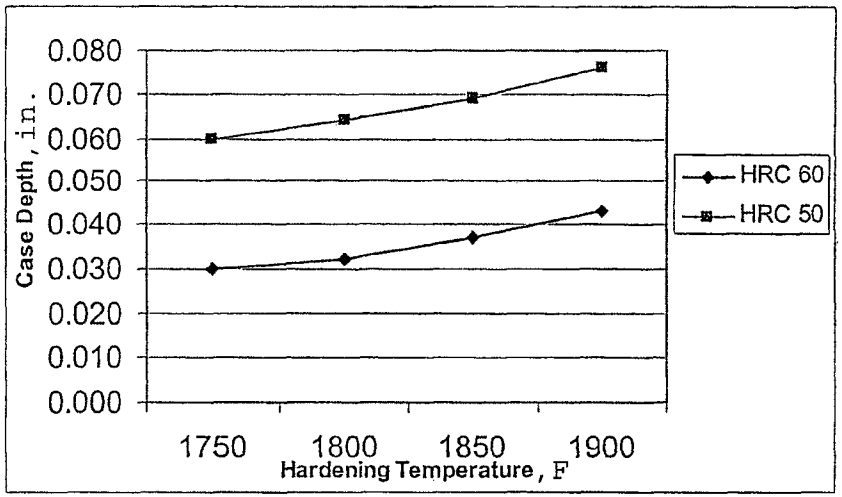
FIG. 14 is a plot illustrating case depth versus hardening temperature of Pyrowear 675.
Figure 15:
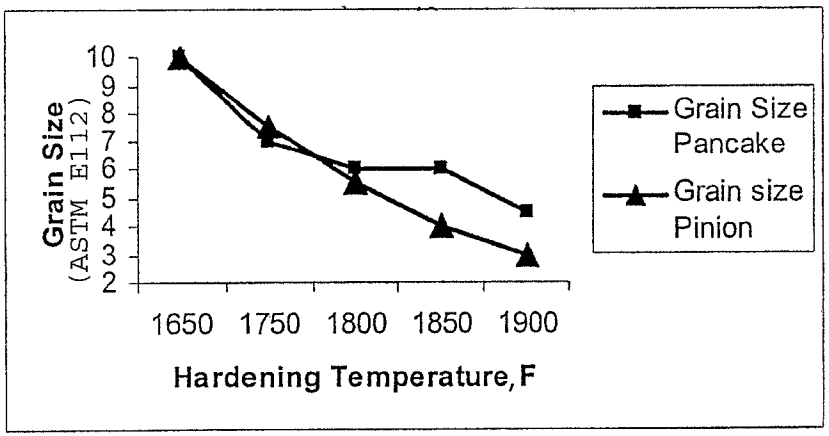
FIG. 15 is a plot illustrating core grain size versus hardening temperature for Pyrowear 675.

Additional testing and subsequent metallographic evaluation of case microstructures revealed that the case microstructures were not affected by hardening temperatures of 1900° F., 1850° F., 1800° F., and 1750° F. The cases all had uniformly dispersed carbides without any carbide stringers or continuous carbide networks, much less along the grain boundaries. Case hardness measurements were made, and a graph of the results is illustrated in FIG. 14. Core grain size versus hardening temperature are illustrated in FIG. 15. Case depth to HRC50 increased at a rate of 0.005" per 50 degrees increase in hardening temperature. Case residual stress measurements were also made. A case compressive residual stress −40KSI, was achieved in the 1900° F., and 1850° F. hardened materials. A tensile residual stress was obtained in the 1800° F., and 1750° F. hardened materials. Based on this, in one form, a balance of properties is achieved with post-carburization hardening below 1900° F. to yield a fine grain in the core and 1850° F. or above to achieve a compressive residual stress in the core.

By forging Pyrowear 675 using the inventive temperature and strain information herein, followed by hardening below 1900° F., as set forth herein, the resulting carburized case microstructure is improved and the fatigue strength of the gear core material is improved. Pyrowear 675 with a pre-carburized grain size of 7, when carburized, will produce a case microstructure of a uniformly dispersed chromium carbides without carbide networking. This case microstructure is more resistant to cracking than case microstructures with continuous carbide stringers along the austenite grain boundaries of previous course grained forgings.

Embodiments of the present invention include a method for thermal mechanical processing of a martensitic stainless steel, comprising: heating a martensitic stainless steel mult to less than or equal to about 1850° F.; forging the mult at less than or equal to about 1800° F. to yield a forged object having a selected portion with an ASTM E112 grain size of 5 or finer; and carburizing the forged object.

In a refinement, the martensitic stainless steel is Pyrowear 675.

In a refinement, the martensitic stainless steel has a nominal composition, by weight, consisting essentially of:

| | |
|---|---|
| Chromium | 13.1% |
| Nickel | 2.5% |
| Molybdenum | 1.8% |
| Cobalt | 5.3% |
| Manganese | 0.7% |
| Vanadium | 0.6% |
| Carbon | 0.07% |
| Si | 0.4% |
| N | 0.002 max. |
| Iron | balance |

In another refinement, the method further includes material removal processing prior to the carburizing.

In another refinement of the embodiment the carburizing is vacuum carburizing.

In another refinement, the carburizing yields the forged object having a case structure substantially free of grain boundary carbide networking.

In yet another refinement, the carburizing yields the case structure substantially free of grain boundary carbide stringers.

In still another refinement, the carburizing yields the case structure having uniformly dispersed chromium carbides.

In another refinement of the embodiment the selected portion has an ASTM E112 grain size of 7 or finer and wherein the forging is performed with a total effective strain of at least 0.3.

In another refinement of the embodiment the selected portion corresponds to the location of gear teeth in a finished product manufactured from the forged object.

In another refinement of the embodiment the total effective strain in the selected portion is at least about 0.5.

Yet another embodiment includes a method for thermal mechanical processing of a Pyrowear 675 alloy. The method includes heating a Pyrowear 675 mult to less than 1850° F.; forging the mult at less than 1900° F. with a total effective strain of at least 0.3 to yield a forged object having a selected portion with an ASTM E112 grain size of 5 or finer; and carburizing the forged object.

In a refinement, the Pyrowear 675 alloy has a nominal composition, by weight, consisting essentially of:

| | |
|---|---|
| Chromium | 13.1% |
| Nickel | 2.5% |
| Molybdenum | 1.8% |
| Cobalt | 5.3% |
| Manganese | 0.7% |
| Vanadium | 0.6% |

-continued

| | |
|---|---|
| Carbon | 0.07% |
| Si | 0.4% |
| N | 0.002 max. |
| Iron | balance |

In a refinement of the embodiment further includes forging the mult with a total effective strain of at least 0.5 to yield the forged object having the selected portion with an ASTM E112 grain size of 7 or finer.

In a refinement of the embodiment further includes forgoing the mult at less than 1800 F to yield the forged object having the selected portion with an ASTM E112 grain size 7 or finer.

In another refinement of the embodiment the carburizing yields the forged object having a case depth of at least 0.030 inches with a minimum hardness of HRC 50 or greater.

In another refinement of the embodiment the case depth is in the range of about 0.060 inches to 0.076 inches with a minimum hardness of HRC 50 or greater.

Another refinement of the embodiment may include hardening the forged object after said carburizing, and performing a quench after said hardening.

Another refinement of the embodiment may include performing an oil quench after said hardening.

In another refinement of the embodiment the hardening is performed at a temperature less than or equal to about 1900° F.

In another refinement of the embodiment the hardening is performed at or above 1850° F.

In another refinement of the embodiment the carburizing yields the forged object having a case structure substantially free of grain boundary carbide stringers.

Another embodiment of the present invention is a method for thermal mechanical processing of a Pyrowear 675 alloy, comprising: heating a Pyrowear 675 mult to less than or equal to 1850° F.; forging the mult at less than or equal to 1800° F. with a total effective strain of at least 0.5 to yield a forged object; and carburizing the forged object.

In one refinement of the embodiment the total effective strain is at least about 0.7.

In another refinement of the embodiment the total effective strain is at least about 0.8.

Another refinement of the embodiment may include annealing the forged object.

In another refinement of the embodiment the annealing is performed after said carburizing.

In another refinement of the embodiment the annealing is performed at about 1200° F.

In another refinement of the embodiment the carburizing yields the forged object having a case structure substantially free of grain boundary carbide stringers.

In another refinement of the embodiment, wherein said carburizing is performed on the selected portion.

While the invention has been described in connection with what is presently considered to be the most practical and preferred embodiment, it is to be understood that the invention is not to be limited to the disclosed embodiment(s), but on the contrary, is intended to cover various modifications and equivalent arrangements included within the spirit and scope of the appended claims, which scope is to be accorded the broadest interpretation so as to encompass all such modifications and equivalent structures as permitted under the law. Furthermore it should be understood that while the use of the word preferable, preferably, or preferred in the description above indicates that feature so described may be more desirable, it nonetheless may not be necessary and any embodiment lacking the same may be contemplated as within the scope of the invention, that scope being defined by the claims that follow. In reading the claims it is intended that when words such as "a," "an," "at least one" and "at least a portion" are used, there is no intention to limit the claim to only one item unless specifically stated to the contrary in the claim. Further, when the language "at least a portion" and/or "a portion" is used the item may include a portion and/or the entire item unless specifically stated to the contrary.

What is claimed is:

1. A method for thermal mechanical processing of a martensitic stainless steel, comprising:

heating a martensitic stainless steel mult to less than or equal to about 1850° F.;

forging the mult at less than or equal to about 1900° F., wherein the forging is performed with a strain rate configured to yield a forged object having a selected portion with an ASTM E112 grain size of 5 or finer; and carburizing the forged object.

2. The method of claim 1, wherein the martensitic stainless steel has a nominal composition, by weight, consisting essentially of:

| | |
|---|---|
| Chromium | 13.1% |
| Nickel | 2.5% |
| Molybdenum | 1.8% |
| Cobalt | 5.3% |
| Manganese | 0.7% |
| Vanadium | 0.6% |
| Carbon | 0.07% |
| Si | 0.4% |
| N | 0.002 max. |
| Iron | balance |

3. The method of claim 1, which further includes material removal processing prior to said carburizing.

4. The method of claim 1, wherein said carburizing is vacuum carburizing.

5. The method of claim 1, wherein said carburizing yields the forged object having a case structure substantially free of grain boundary carbide networking.

6. The method of claim 5, wherein said carburizing yields the case structure substantially free of grain boundary carbide stringers.

7. The method of claim 5, wherein said carburizing yields the case structure having uniformly dispersed chromium carbides.

8. The method of claim 1, wherein the selected portion has an ASTM E112 grain size of 7 or finer, and wherein the forging is performed with a total effective strain of at least 0.3.

9. The method of claim 8, wherein the selected portion corresponds to a location of gear teeth in a finished product manufactured from the forged object.

10. The method of claim 8, wherein the total effective strain in the selected portion is at least about 0.5.

11. A method for thermal mechanical processing of a martensitic stainless steel, comprising:

heating a martensitic stainless steel mult to less than 1850° F.;

forging the mult at less than 1900° F. with a total effective strain of at least 0.3 to yield a forged object having a selected portion with an ASTM E112 grain size of 5 or finer; and carburizing the forged object.

12. The method of claim 11, wherein the martensitic stainless steel has a nominal composition, by weight, consisting essentially of:

| | |
|---|---|
| Chromium | 13.1% |
| Nickel | 2.5% |
| Molybdenum | 1.8% |
| Cobalt | 5.3% |
| Manganese | 0.7% |
| Vanadium | 0.6% |
| Carbon | 0.07% |
| Si | 0.4% |
| N | 0.002 max. |
| Iron | balance |

13. The method of claim 11, further comprising forging the mult with a total effective strain of at least 0.5 to yield the forged object having the selected portion with an ASTM E112 grain size of 7 or finer.

14. The method of claim 11, further comprising forging the mult at less than 1800° F. to yield the forged object having the selected portion with an ASTM E112 grain size of 7 or finer.

15. The method of claim 11, wherein said carburizing yields the forged object having a case depth of at least 0.030 inches to a minimum hardness of HRC 50 or greater.

16. The method of claim 15, wherein the case depth is in a range of about 0.060 inches to 0.076 inches to a minimum hardness of HRC 50 or greater.

17. The method of claim 11, further comprising hardening the forged object after said carburizing, and performing a quench after said hardening.

18. The method of claim 17, wherein said hardening is performed at a temperature less than or equal to about 1900° F.

19. The method of claim 18, wherein said hardening is performed at or above 1850° F.

20. The method of claim 11, wherein said carburizing yields the forged object having a case structure substantially free of grain boundary carbide stringers.

21. A method for thermal mechanical processing of a martensitic stainless steel, comprising:

heating a martensitic stainless steel mult to less than or equal to 1850° F.;

forging the mult at less than or equal to 1800° F. to yield a forged object, with a total effective strain of at least 0.5 in a selected portion of the forged object; and carburizing the forged object.

22. The method of claim 21, wherein the total effective strain is at least 0.7.

23. The method of claim 21, wherein the total effective strain is at least 0.8.

24. The method of claim 21, further comprising annealing the forged object.

25. The method of claim 24, wherein said annealing is performed after said carburizing.

26. The method of claim 25, wherein said annealing is performed at about 1200° F.

27. The method of claim 21, wherein said carburizing yields the forged object having a case structure substantially free of grain boundary carbide stringers.

28. The method of claim 27, wherein said carburizing is performed on the selected portion.

* * * * *